US008579125B2

(12) United States Patent
Trinh et al.

(10) Patent No.: US 8,579,125 B2
(45) Date of Patent: Nov. 12, 2013

(54) FRAGRANCE TEST BOTTLE DISPLAY FIXTURE

(75) Inventors: Nick Q. Trinh, Minneapolis, MN (US); Vaughan R. Schaub, Golden Valley, MN (US)

(73) Assignee: Target Brands, Inc., Minneapolis, MN (US)

( * ) Notice: Subject to any disclaimer, the term of this patent is extended or adjusted under 35 U.S.C. 154(b) by 335 days.

(21) Appl. No.: 12/901,686

(22) Filed: Oct. 11, 2010

(65) Prior Publication Data

US 2012/0085717 A1 Apr. 12, 2012

(51) Int. Cl.

| | |
|---|---|
| ***A47B 73/00*** | (2006.01) |
| *A47F 3/14* | (2006.01) |
| *B65D 1/34* | (2006.01) |
| *B65D 69/00* | (2006.01) |

(52) U.S. Cl.

USPC ..... 211/74; 211/126.16; 206/560; 206/581

(58) Field of Classification Search

USPC ..... 211/126.16, 128.1, 130.1, 132.1, 133.6, 211/61, 85.2, 39, 70.3, 65, 70.1, 72, 71.01, 211/69, 74; 132/294, 295, 296, 300, 303; 206/559, 560, 564, 562, 581; 190/16

See application file for complete search history.

(56) References Cited

U.S. PATENT DOCUMENTS

| | | | | |
|---|---|---|---|---|
| 1,236,085 | A * | 8/1917 | Hudnut | 206/560 |
| 2,362,367 | A | 11/1944 | Freeman | |
| 2,430,166 | A * | 11/1947 | Fish et al. | 211/130.1 |
| 3,602,372 | A | 8/1971 | Verrecchio | |
| 3,638,664 | A | 2/1972 | Cohn | |
| 4,155,460 | A * | 5/1979 | Ratti | 211/70.6 |
| 4,799,588 | A * | 1/1989 | Trisl | 206/301 |
| 5,312,000 | A * | 5/1994 | Bass | 211/4 |
| 5,344,027 | A | 9/1994 | Kaplan | |
| 5,358,101 | A | 10/1994 | Lombardi | |
| 5,706,977 | A | 1/1998 | Ogura et al. | |
| 5,711,435 | A * | 1/1998 | Morison et al. | 211/90.01 |
| 6,096,562 | A * | 8/2000 | Bunn et al. | 436/518 |
| 6,920,986 | B2 * | 7/2005 | Lacombe et al. | 211/70.6 |
| 7,007,814 | B2 | 3/2006 | Ploix | |
| 7,287,652 | B2 * | 10/2007 | Scholen et al. | 211/26 |

(Continued)

FOREIGN PATENT DOCUMENTS

| | | | |
|---|---|---|---|
| EP | 774224 | A2 | 5/1997 |
| FR | 2712471 | A1 | 5/1995 |

(Continued)

*Primary Examiner* — Jonathan Liu
*Assistant Examiner* — Patrick Hawn
(74) *Attorney, Agent, or Firm* — Leanne Taveggia Farrell; Westman, Champlin & Koehler, P.A.

(57) ABSTRACT

A display fixture includes a base and a plurality of fragrance plate assemblies mounted to the base. The base includes a top having a top surface, a front, a back, opposing ends and a well. The well has a well surface recessed from the top surface and includes a plurality of openings in the well surface. Each of the fragrance plate assemblies includes a plate with a recess having a geometric shape constructed to correspond to a geometric contour of a bottom of a fragrance bottle, a pair of plate hooks and a pair of spacers attaching the plate to the pair of plate hooks. The pair of plate hooks are inserted into two of the openings in the well to secure each fragrance plate assembly to the base.

16 Claims, 6 Drawing Sheets

(56) References Cited

U.S. PATENT DOCUMENTS

| | | | |
|---|---|---|---|
| 7,665,860 | B2 | 2/2010 | Demarest et al. |
| 2005/0279579 | A1 | 12/2005 | Milk et al. |
| 2008/0121563 | A1 | 5/2008 | Polvere et al. |
| 2009/0296385 | A1 | 12/2009 | Demarest et al. |

FOREIGN PATENT DOCUMENTS

| | | | | | |
|---|---|---|---|---|---|
| FR | 2903876 | A1 | | 1/2008 | |
| JP | 09028529 | A | * | 2/1997 | ..... A47F 7/00 |
| JP | 11076016 | A | | 3/1999 | |
| JP | 2000175792 | A | * | 6/2000 | ..... A47F 7/00 |

* cited by examiner

FRAGRANCE TEST BOTTLE DISPLAY FIXTURE

BACKGROUND

Retail stores use a variety of product display structures to present products to customers for purchase. These product display structures can support the product for display and can indicate the product price. Example product display structures include shelves, racks, peg hooks and other similar structures.

Display fixtures mount to or rest on a product display structure. Such display fixtures can include signs for highlighting the product on display and/or include structures that hold samples of the product for testing.

The discussion above is merely provided for general background information and is not intended to be used as an aid in determining the scope of the claimed subject matter.

SUMMARY

A display fixture includes a base and a plurality of fragrance plate assemblies. The base includes a top having a top surface, a front, a back, a first end, a second end and a well. The well has a well surface recessed from the top surface and includes a plurality of openings in the well surface. Each of the fragrance plate assemblies includes a plate with a recess having a geometric shape constructed to correspond to a geometric shape of a bottom of a fragrance bottle, a pair of plate hooks and a pair of spacers attaching the plate to the pair of plate hooks. The pair of plate hooks for each fragrance plate assembly are inserted into two of the openings in the well surface to secure each fragrance plate assembly to the base. The fragrance plate assembly is then shifted in a direction towards a fixed end plate at the first end or a previously inserted fragrance plate assembly in sequential order until a removable end plate can be mounted adjacent the second end.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Embodiments described herein include a fragrance test bottle display fixture having a base for receiving fragrance plate assemblies that support fragrance test bottles and for receiving a sign holder. Portions of the fragrance plate assemblies and their corresponding fragrance test bottles are affixed together and mounted to the base so as to allow fragrances to be tested by guests in a retail store in an uncluttered and visually appealing way.

Figure 1:
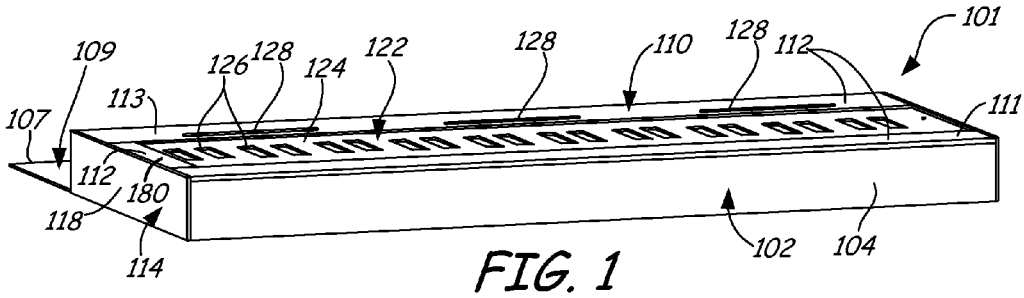
FIG. 1 illustrates a perspective view of a base of a fragrance test bottle display fixture under one embodiment.
Figure 2:
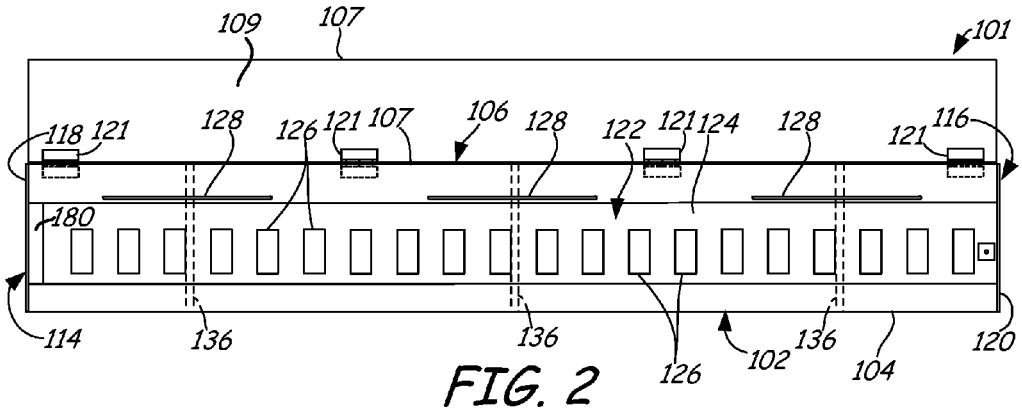
FIG. 2 illustrates a top view of the base illustrated in FIG. 1.

FIGS. 1 and 2 illustrate perspective and top views, respectively, of a base 101 of a fragrance test bottle display fixture under one embodiment. Base 101 includes a front 102 having a front surface 104, a back 106 having a back surface 107, a top 110 having top surfaces 112 and opposing ends 114 and 116 having corresponding end surfaces 118 and 120. More specifically, a front top plate 111, a back top plate 113, a first end plate 180 and a second end plate (not illustrated in FIGS. 1-2 and 4-6) together form top 110 of base 101. Therefore, front top plate 111, back top plate 113, first end plate 180 and the second end plate include top surfaces 112.

Base 101 includes a well 122 having a well surface 124. The bottom of first end plate 180 is fixedly coupled to well surface 124 of well 122, while second end plate (not shown) is removably coupled to well surface 124 of well 122. Well surface 124 is recessed from the top surfaces 112 of front top plate 111, back top plate 113, first end plate 180 and the second end plate and includes a plurality of openings 126 located between front and back top plates 111 and 113 and between first end plate 180 and the second end plate.

Base 101 also includes a door 109 coupled to back 106 by a plurality of hinges 121 (portions of which are shown in phantom or dashed lines in the FIG. 2 top view). As illustrated in FIGS. 1 and 2, door 109 is in an open position. In the open position, door 109 is substantially perpendicular to and extends outwardly from back 106. The outward extension enlarges the front-to-back width of base 101 such that base 101 can sit on a wider-sized shelf than a shelf that has a size that corresponds with the width between front 102 and back 106. In addition, when open, a free edge 107 of door 109 can be made flush with the back of the larger-sized shelf to stabilize base 101.

As illustrated in phantom or in dashed lines in FIG. 2, base 101 includes a plurality of supports 136. More particularly, base 101 includes three supports. However, any number of supports can be used to provide structural integrity to the components of base 101. Back top plate 113 of base 101 includes a plurality of slots 128 recessed from top surface 112. The plurality of slots 128 receive tabs on a sign holder, such as tabs 132 on sign holder 130 illustrated in FIG. 3. Although FIGS. 1 and 2 illustrate base 101 as having three slots 128, base 101 can include any number of slots for receiving any number of tabs on a sign holder.

Figure 3:
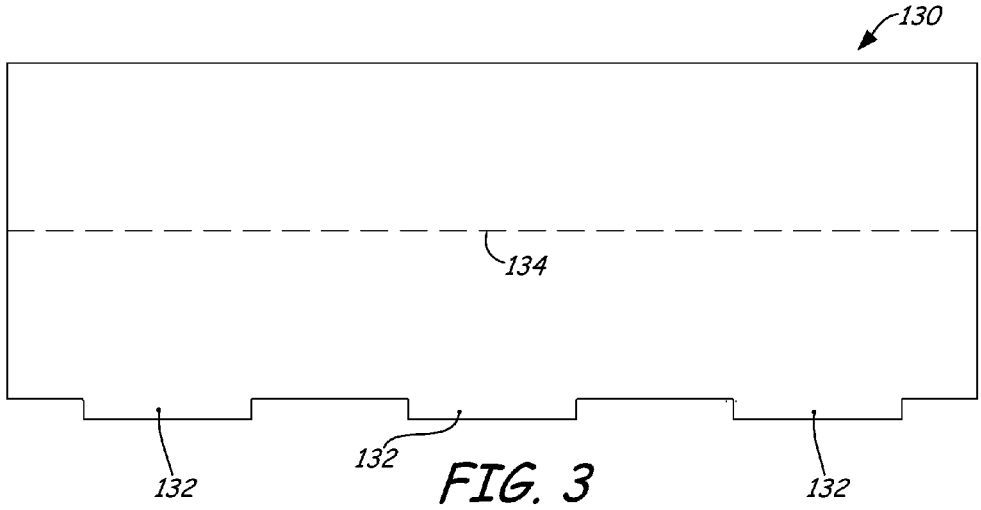
FIG. 3 illustrates a plan view of a sign holder before it is folded for insertion into the base illustrated in FIG. 1.

FIG. 3 is a plan view of sign holder 130 before it is folded for insertion into slots 128 of base 101. More specifically, sign holder 130 includes a bend line 134. Sign holder 130 is folded at bend line 134 to create a sleeve for holding a sign. Tabs 132 are inserted into sign holder 130 to display the sign on base 101.

Figure 4:
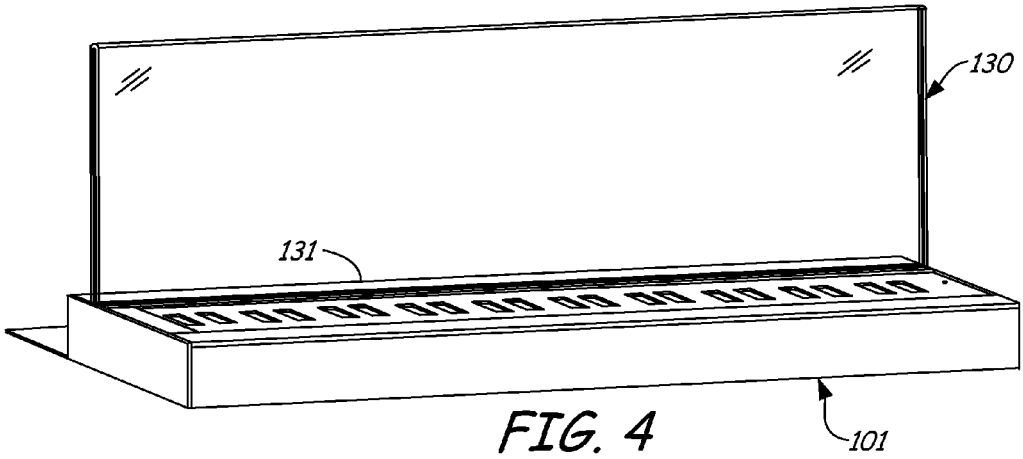
FIG. 4 illustrates a perspective view of the base illustrated in FIG. 1 assembled together with the sign holder of FIG. 3.

FIGS. 4, 5, 6, 7 and 8 illustrate perspective, front, top, sectional and side views, respectively, of base 101 and sign holder 130 assembled together. As illustrated in FIG. 4, sign holder 130 is transparent such that a back edge 131 of base 101 is visible. When a printed sign is inserted into sign holder 130, however, the back edge is no longer visible. In addition, sign holder 130 may only be partially transparent. For example, the front portion of sign holder 130 might be transparent, while the back portion could be opaque.

Figure 5:
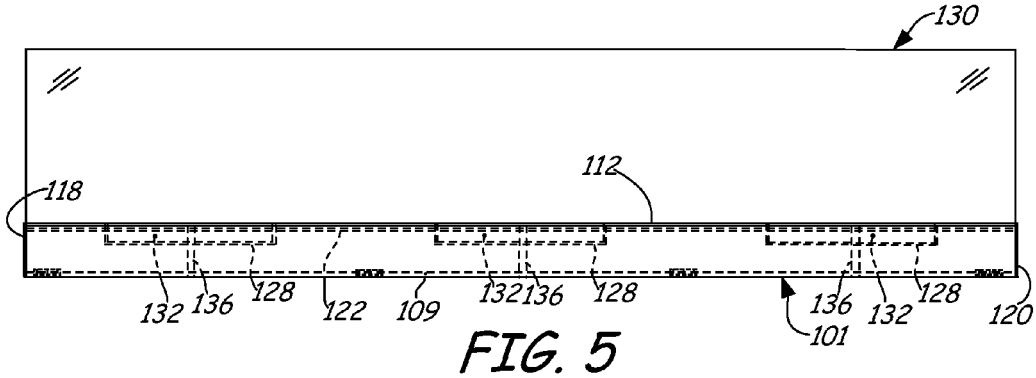
FIG. 5 illustrates a front view of the assembled base and sign holder illustrated in FIG. 4.
Figure 6:
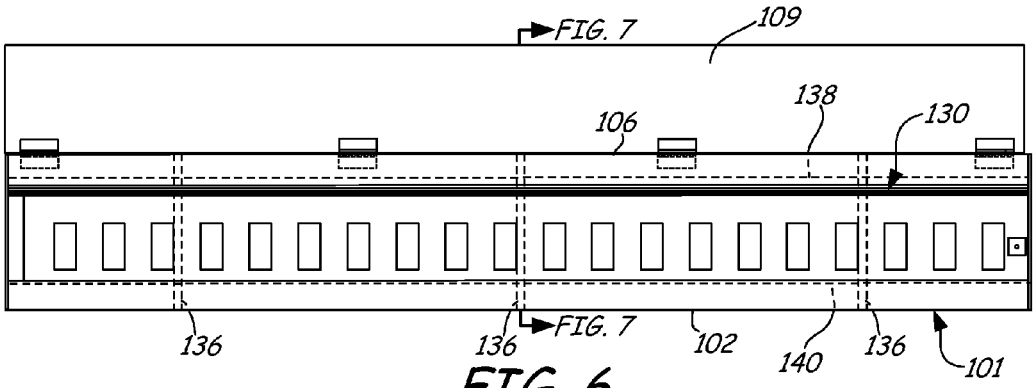
FIG. 6 illustrates a top view of the assembled base and sign holder illustrated in FIG. 4.

As illustrated in FIGS. 5 and 6, internal components of the base 101 are illustrated in phantom or dashed lines. For example, tabs 132 of sign holder 130 and slots 128 are illustrated in FIG. 5 showing their respective depths from top surface 112. In another example, the component that defines well 122 is illustrated in FIG. 5 showing its respective depth. In yet another example, supports 136 are illustrated in FIGS. 5 and 6 showing their relative location. In still another example, door 109 is illustrated in FIGS. 5 and 6 showing its location when in the open position. Base 101 also includes dashed lines indicating a first well holder strip 138 and a second well holder strip 140. First and second well holder strips 138 and 140 secure well 122 between front 102 and back 106.

Figure 7:
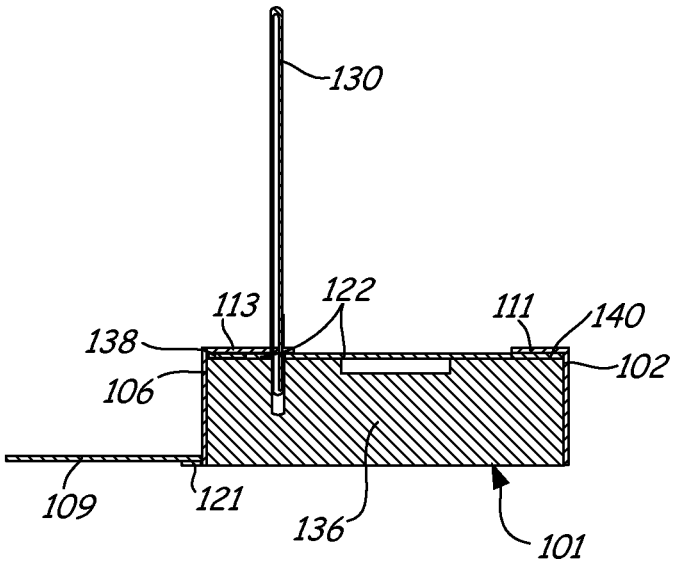
FIG. 7 illustrates a sectional view of the assembled base and sign holder illustrated in FIG. 4.

The sectional view illustrated in FIG. 7 is taken along a width of the base 101 including door 109 at one of the supports 136 as indicated in FIG. 6. As illustrated in the sectional view of FIG. 7, support 136, sign holder 130, door 109, hinge 121 and first and second well holder strips 138 and 140 are made of a transparent material, such as transparent acrylic. Front 102, back 106, top 112 and well 122 are made of an opaque acrylic, such as a black or other colored acrylic. As illustrated in FIG. 7, first well holder strip 138 is located between well 122 and back 106 and under back top plate 113 and second well holder strip 140 is located between well 122 and back 106 and under front top plate 111.

Figure 8:
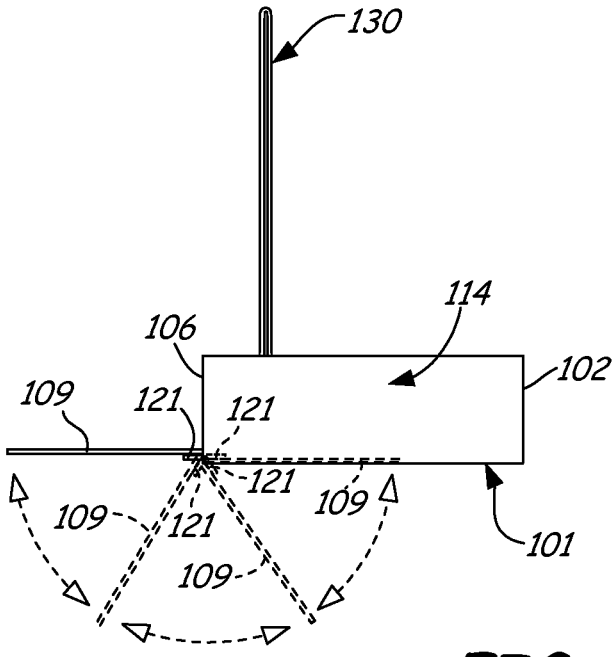
FIG. 8 illustrates a side view of the assembled base and sign holder illustrated in FIG. 4.

In the side view illustrated in FIG. 8, door 109 is illustrated in an open position and the rotatable movement of door 109 is illustrated in phantom or dashed lines. As discussed above, when door 109 is in the open position, door 109 extends outwardly from back 106 to enlarge the front-to-back width of base 101. When door 109 is moved about hinges 121 into a closed position, it is located and occupies space under base 101 between front 102 and back 106. In the closed position, door 109 is also substantially perpendicular to back 106, but does not make the front-to-back width of base 101 larger. Rather, base 101 can rest on a shelf that has a width corresponding to a width between front 102 and back 106. In addition, when closed, the back 106 of base 101 can be made flush with a back of the smaller-sized shelf to stabilize base 101.

Figure 9:
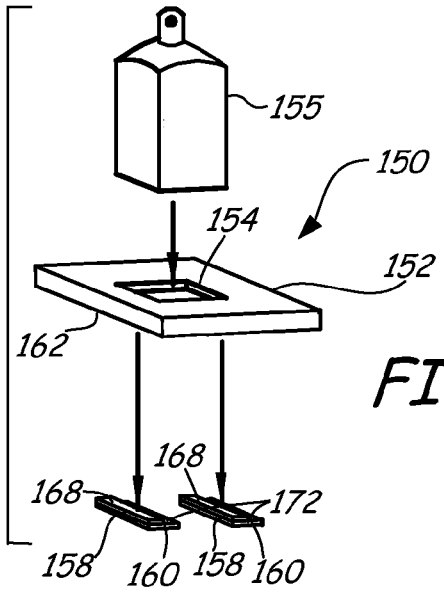
FIG. 9 illustrates an exploded perspective view of a fragrance plate assembly under one embodiment.
Figure 10:
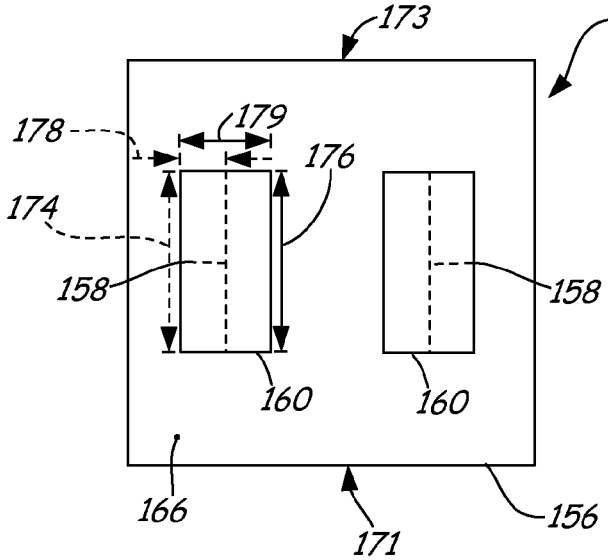
FIG. 10 illustrates a bottom view of the fragrance plate assembly illustrated in FIG. 9.
Figure 11:
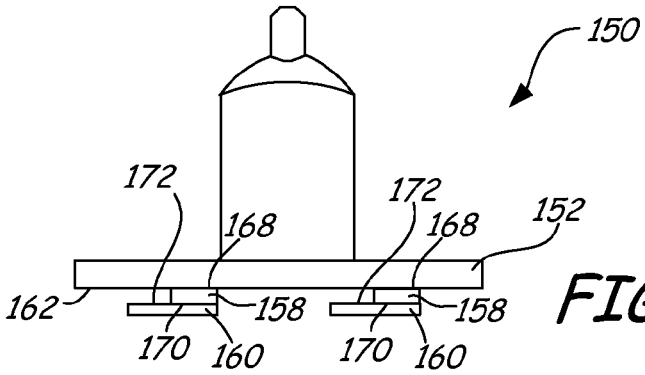
FIG. 11 illustrates a front view of the fragrance plate assembly illustrated in FIG. 9.

FIG. 9 illustrates an exploded perspective view, FIG. 10 illustrates a bottom view and FIG. 11 illustrates a side view of a fragrance plate assembly 150, or also referred to as a test bottle assembly 150, under one embodiment. It should be realized that the perspective view in FIG. 9 is shown from a first side 171 (denoted in the bottom view of fragrance plate assembly 150), while the side view illustrated in FIG. 11 is shown from a second side 173 (denoted in the bottom view of fragrance plate assembly 150).

Fragrance plate assembly 150 includes a plate 152 having a centrally located recess 154, a pair of spacers 158 and a pair of plate hooks 160. Recess 154 is shaped to correspond with the geometrical shape of a bottom of fragrance bottle 155, while plate 152 acts to support the bottom of the fragrance bottle 155. It should be realized that fragrance plate assembly 150 can include other types of configurations. For example, plate 152 can have an upper and a lower plate adhered together, where the upper plate includes a through hole or aperture with the geometrical shape of a bottom of fragrance bottle 155 and the lower plate is solid to thereby support the bottom of the fragrance bottle that is in the aperture.

As shown in the assembled illustration of FIG. 11, a bottom surface 162 of plate 152 is directly attached to a top surface 168 of spacers 158. For example, bottom surface 162 can be directly affixed to top surface 168 by an adhesive. Bottom surfaces 170 of spacers 158 are directly attached to top surfaces 172 of plate hooks 160. For example, bottom surfaces 170 can be directly affixed to top surfaces 172 by an adhesive. In addition, the bottom of fragrance bottle 155 can be affixed to a recessed surface of recess 154 of plate 152 by an adhesive. In such an embodiment, the spritzer portion of the fragrance bottle 155 can be used for testing even though it is secured to the plate assembly 150, thereby preventing the test bottle 150 from becoming misplaced.

Plate 152 includes lengthwise and widthwise dimensions. The pair of spacers 158 and the pair of plate hooks 160 have smaller dimensions than plate 152. More specifically, spacers 158 have the same widthwise dimension 174 as the widthwise dimension 176 of plate hooks 160, which is smaller than the widthwise dimension of plate 152. However, spacers 158 have a smaller lengthwise dimension 178 than the lengthwise dimension 179 of plate hooks 160. Therefore, as illustrated in FIG. 11, plate hooks 160 are cantilevered from spacers 158 to form hooks between top surfaces 172 and bottom surface 162.

Figure 12:
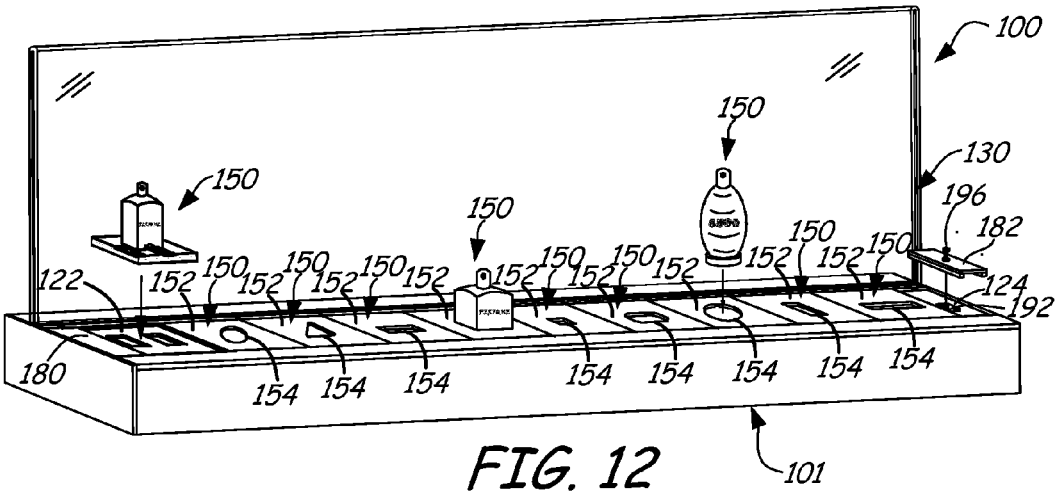
FIG. 12 illustrates a partially exploded perspective view of a fragrance test bottle display fixture under one embodiment.

FIG. 12 illustrates a partially exploded perspective view of a fragrance test bottle display fixture 100 including base 101, sign holder 130 and a plurality of fragrance plate assemblies 150. In FIG. 12, the leftmost (or first from the left) fragrance plate assembly 150 and fifth from the left fragrance plate assembly 150 are in fully assembled states including the fragrance bottle, the plate, the spacers and the plate hooks all attached or affixed together. The second, third, fourth, sixth, seventh, eighth, ninth and tenth from the left fragrance plate assemblies 150 are not fully assembled. While they include the plate, the spacers and the plate hooks all attached or affixed together, the fragrance bottles are not yet attached to the plate. In FIG. 12, each fragrance plate assembly 150 includes a recess 154 in plate 152 geometrically shaped to accommodate a type of fragrance test bottle that has a corresponding geometrical shape, for example triangular, circular, rectangular and so forth.

As described previously and as illustrated in FIG. 12, fragrance test bottle display fixture 100 also includes two end plates. The first end plate 180 is fixedly coupled to well 122 of base 101 and mounted adjacent end 114. The second end plate 182 is removably coupled to well 122 of base 101 and located adjacent to end 116 when mounted in place. Although FIG. 12 illustrates leftmost end plate or first end plate 180 as being fixed and rightmost or second end plate 182 as being removable, which end plate is placed on which end can be reversed. For example, the leftmost end plate or first end plate 180 can be removably coupled to well 122 while the rightmost end plate or second end plate 182 can be fixedly coupled to well 122. To assemble fragrance plate assemblies 150 to base 101, each fragrance plate assembly 150 is mounted to base 101 beginning at the fixed end plate 180. As illustrated in FIG. 12, the fragrance plate assembly 150 mounted adjacent to fixed end plate 180 is shown exploded. Such is for the purposes of illustrating the well 122 and is not illustrative of how fragrance plate assemblies 150 are mounted to base 101. In fact, in the embodiment illustrated in FIG. 12, the fragrance plate assembly 150 mounted adjacent to first end plate 180 would be the first fragrance plate assembly 150 to be mounted to base and could not be removed from base 101 until all other fragrance plate assemblies 150 were removed. In other words, when the fixed end plate is located adjacent end 114 of base 101 and the removable end plate is to be mounted adjacent to end 116 of base 101, fragrance plate assemblies 150 should be mounted in sequential order from left to right (i.e., one after the other) from end 114 to end 116. More particularly, the fragrance plate assembly 150 located closest to the fixed end plate is mounted first and the fragrance plate assembly 150 located closest to the removable end plate is mounted last.

Figure 13A:
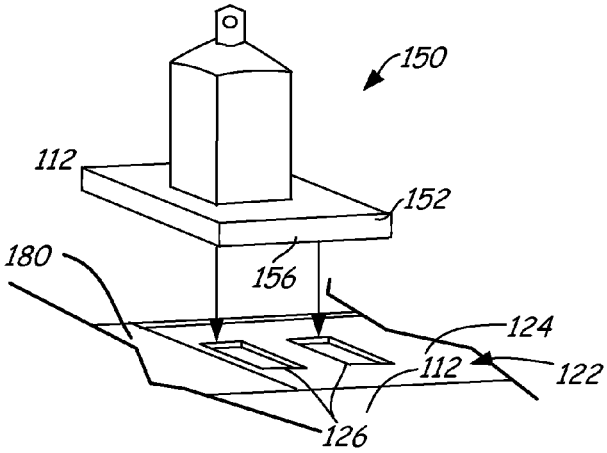
FIGS. 13A and 13B illustrate a fragrance plate assembly being mounted to the base of the fragrance test bottle display fixture illustrated in FIG. 12.
Figure 13B:
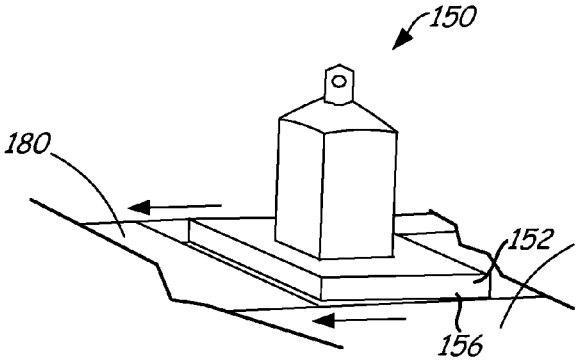

FIGS. 13A and 13B illustrates an enlarged perspective view of a fragrance plate assembly 150 being mounted to base 101 of fragrance test bottle display structure 100 adjacent to the first or fixed end plate 180, which is located on the left end of the fragrance test bottle display fixture in the embodiment illustrated in FIG. 12. In such a configuration, where first or fixed end plate 180 is located on the left end, fragrance plate assembly 150 is oriented such that second side 173 is facing forward as is illustrated in FIG. 11. Fragrance plate assembly 150 is set downwardly into well 122 and the pair of plate hooks and spacers (not illustrated in FIGS. 13A or 13B) are inserted into the two openings 126 in well surface 124 of well 122. Therefore, each opening in well surface 124 corresponds with a widthwise dimension 176 and a lengthwise dimension 179 of a plate hook 160. After fragrance plate assembly 150 is inserted, fragrance plate assembly 150 is slid or shifted in the direction of the arrows illustrated in FIG. 13B, which are in the direction of first or fixed end plate 180, so that sides of plate 152 fits flush against the end plate 180 of base 101 and plate 152 fits flush against the front top plate 111 and back top plate 113 of base 101.

Each subsequently mounted fragrance plate assembly 150 is also set downwardly into well 122 and their pair of plate hooks 160 inserted into two corresponding openings 126 in well surface 124. After insertion, each fragrance plate assembly 150 is slid or shifted in the direction of the illustrated arrows in FIG. 13B, which are in the direction of the first or fixed end plate 180, so that sides of plate 152 fits flush against the plate 152 of the adjacent fragrance plate assembly 150 and plate 152 fits flush against the front top plate 111 and back top plate 113 of base 101.

The last fragrance plate assembly 150 to be mounted is downwardly set into well 122 so as to insert its pair of plate hooks 160 into the two corresponding openings 126 in well surface 124 of well 122. After insertion, the last fragrance plate assembly 150 is slid or shifted in the direction of the illustrated arrows in FIG. 13B, which are in the direction of the first or fixed end plate 180, so that sides of the plate 152 fits flush against the plate 152 of the adjacent fragrance plate assembly 150 and plate 152 fits flush against the front top plate 111 and back top plate 113 of base 101. Lastly, the second or removable end plate 182 is mounted adjacent to the last fragrance plate assembly 150 such that it fits flush against the plate 152.

Figure 14A:
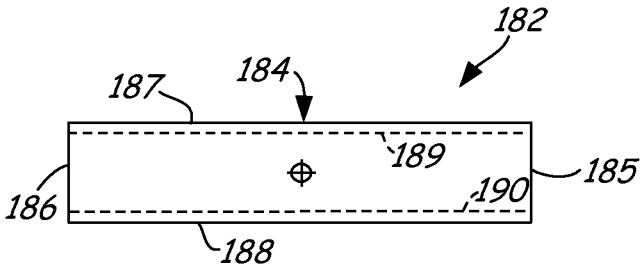
FIG. 14A and 14B illustrate the end plate illustrated in FIG. 12.
Figure 14B:
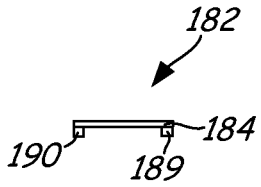

FIGS. 14A and 14B illustrate a top view and a front end view of second or removable end plate 182. As illustrated, end plate 182 includes an upper plate 184 having a front edge 185, a back edge 186 and two side edges 187 and 188. End plate 182 also includes two protruding pieces 189 and 190 that extend downwards from upper plate 184 and run along the two side edges 187 and 188 from front edge 185 to back edge 186. When end plate 182 is placed adjacent to the last mounted fragrance plate assembly 150, protruding pieces 189 and 190 fit into well 122 while upper plate 184 can fit flush against the upper plate 152 of the adjacent fragrance plate assembly 150 and flush against end 116.

Figure 15:
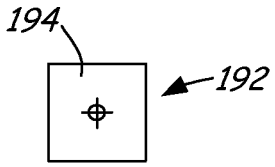
FIG. 15 illustrates an end plate anchor cube for mounting the end plate illustrated in FIGS. 14A and 14B to the fragrance test bottle display fixture illustrated in FIG. 12.

Fragrance test bottle display structure also includes an end plate anchor cube 192 as illustrated in FIG. 12 and as illustrated in a top view in FIG. 15. End plate anchor cube 192 is located on well surface 124 directly under second or removable end plate 182. End plate anchor cube 192 anchors to base 101 on its bottom and provide an opening for anchoring second or removable end plate 182 to its top 194. Second or removable end plate 182 is secured to end plate anchor cube 192 using a fastener 196. For example, end plate anchor cube 192 can include a threaded opening and fastener 196 can be a threaded screw of which the threaded opening can receive.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A fragrance test bottle display fixture comprising:

a base including a top having a top surface, a front, a back, opposing ends and a well having a well surface recessed from the top surface, the well surface including a plurality of openings;

a plurality of fragrance plate assemblies mounted to the base, each fragrance plate assembly being constructed to support a fragrance test bottle and comprising:

a plate having a recess, the recess including a geometric shape corresponding to a geometric contour of a bottom of the fragrance test bottle;

a pair of plate hooks directly attached to the plate, wherein each of the pair of plate hooks are inserted into a different one of the plurality of openings in the well surface to secure the fragrance plate assembly to the base;

wherein the base comprises a first and a second end plate, the first end plate being fixedly coupled to the well surface of the well and the second end plate being removably coupled to the well surface of the well; and wherein the plurality of fragrance plate assemblies are configured to be shifted in a direction toward the first end plate after being inserted into the plurality of openings in the well surface and are configured to be secured in place by the second end plate.

2. The fragrance test bottle display fixture of claim 1, wherein the base includes a plurality of slots that are recessed from the top surface, the plurality of slots receiving tabs of a sign holder.

3. The fragrance test bottle display fixture of claim 1, wherein the base further comprises a door rotatably coupled to the back, wherein the door is configured into an open position so as to extend outwardly from the back and is configured into a closed position so as to occupy space under a bottom of the base between the front and the back of the base.

4. The fragrance test bottle display fixture of claim 1, wherein the second end plate is removably coupled to the well with a fastener and an end plate anchor cube.

5. The fragrance test bottle display fixture of claim 1, wherein the pair of plate hooks are coupled to the plate by a pair of spacers.

6. The fragrance test bottle display fixture of claim 5, wherein the pair of spacers are directly attached to the plate with an adhesive and the pair of plate hooks are coupled to the pair of spacers with an adhesive.

7. The fragrance test bottle display fixture of claim 5, wherein the pair of plate hooks comprise lengthwise dimensions that are greater than lengthwise dimensions of the pair of spacers such that each plate hook cantilevers from each spacer.

8. The fragrance test bottle display fixture of claim 6, wherein each opening in the well surface corresponds with a widthwise dimension and the lengthwise dimension of each plate hook.

9. The fragrance test bottle display fixture of claim 1, wherein the fragrance plate assemblies are mountable into the base.

10. A fragrance test bottle display fixture comprising:

a base comprising:

a top including front and back top plates and first and second end plates;

a well including a well surface recessed from the top surfaces of the front top plate, the back top plate and the first and second end plates, the well having a plurality of openings located between the front and back top plates and between the first and second end plates, wherein the front top plate, the back top plate and the first end plate are fixedly coupled to the well surface of the base while the second end plate is removably coupled to the well surface of the base;

a plurality of test bottle assemblies constructed to support fragrance test bottles mounted to the well, wherein portions of each of the test bottle assemblies are inserted into two of the openings in the well surface and each test bottle assembly is adjacent to each other between the first and second end plates; and wherein the plurality test bottle assemblies are configured to be shifted in a direction toward the first end plate after being inserted into the openings in the well surface and are configured to be secured in place by the second end plate.

11. The fragrance test bottle display fixture of claim 10, wherein each test bottle assembly comprises:

a plate having a centrally located recess, the recess including a geometric shape constructed to correspond to a geometric contour of a bottom of the fragrance test bottle;

a pair of spacers directly attached to a bottom surface of the plate; and a pair of plate hooks, each plate hook directly attaching to a bottom surface of one of the pair of spacers, wherein the pair of plate hooks is inserted into two of the openings in the well surface to secure the test bottle assembly to the base.

12. The fragrance test bottle display fixture of claim 11, wherein the pair of spacers being directly attaching to the plate with an adhesive and the pair of plate hooks directly attaching to the pair of spacers with an adhesive.

13. The fragrance test bottle display fixture of claim 11, wherein the pair of plate hooks comprise a widthwise dimension and lengthwise dimension, the lengthwise dimension being greater than lengthwise dimensions of the pair of spacers such that each plate hook cantilevers from each spacer and each opening in the well surface corresponding with the widthwise dimension and the lengthwise dimension of each plate hook.

14. The fragrance test bottle display fixture of claim 10, wherein the back top plate comprises a plurality of slots recessed from the top surface of the back top plate, the plurality of slots being configured to receive a plurality of tabs of a sign holder.

15. A fragrance test bottle display fixture comprising:

a base including a top having a top surface, a front, a back, opposing ends and a well having a well surface recessed from the top surface, the well surface including a plurality of openings;

a plurality of fragrance plate assemblies mounted to the base, each fragrance plate assembly being constructed to support a fragrance test bottle and comprising:

a plate having a recess, the recess including a geometric shape corresponding to a geometric contour of a bottom of the fragrance test bottle;

a pair of plate hooks coupled to the plate, wherein the pair of plate hooks are inserted into two of the openings in the well surface to secure the fragrance plate assembly to the base;

wherein the base comprises a first and a second end plate, the first end plate being fixedly coupled to the well surface of the well and the second end plate being removably coupled to the well surface of the well; and wherein the second end plate is removably coupled to the well with a fastener and an end plate anchor cube.

16. A fragrance test bottle display fixture comprising:

a base including a top having a top surface, a front, a back, opposing ends and a well having a well surface recessed from the top surface, the well surface including a plurality of openings;

a plurality of fragrance plate assemblies mounted to the base, each fragrance plate assembly being constructed to support a fragrance test bottle and comprising:

a plate having a recess, the recess including a geometric shape corresponding to a geometric contour of a bottom of the fragrance test bottle;

a pair of plate hooks coupled to the plate, wherein the pair of plate hooks are inserted into two of the openings in the well surface to secure the fragrance plate assembly to the base;

wherein the pair of plate hooks are coupled to the plate by a pair of spacers; and wherein the pair of spacers are directly attached to the plate with an adhesive and the pair of plate hooks are coupled to the pair of spacers with an adhesive.

* * * * *